US006836915B2

(12) United States Patent
Song et al.

(10) Patent No.: US 6,836,915 B2
(45) Date of Patent: Jan. 4, 2005

(54) PROCESS FOR DYEING POLY (TRIMETHYLENE TEREPHTHALATE) CARPET CONTINUOUSLY

(75) Inventors: Kee-chul Song, Seoul (KR); Je-an Yu, Seoul (KR); Ii-won Jung, Incheon (KR)

(73) Assignee: Hyosung Corporation, Seoul (KR)

( * ) Notice: Subject to any disclaimer, the term of this patent is extended or adjusted under 35 U.S.C. 154(b) by 110 days.

(21) Appl. No.: 10/178,086

(22) Filed: Jun. 24, 2002

(65) Prior Publication Data

US 2003/0028980 A1 Feb. 13, 2003

(30) Foreign Application Priority Data

Jun. 27, 2001 (KR) ..... 2001-36877
Nov. 1, 2001 (KR) ..... 2001-67771

(51) Int. Cl.[7] ..... D06P 5/02; D06P 7/00

(52) U.S. Cl. ..... 8/151; 8/922; 8/929; 8/933; 8/DIG. 4; 8/147; 8/149.1

(58) Field of Search ..... 8/922, 929, 933, 8/DIG. 4, 932, 151, 147, 149.1

(56) References Cited

U.S. PATENT DOCUMENTS 4,101,270 A * 7/1978 Fleissner ..... 8/505
5,782,935 A * 7/1998 Hirt et al. ..... 8/512
6,284,370 B1 * 9/2001 Fujimoto et al. ..... 428/364
6,544,300 B1 * 4/2003 Cliver et al. ..... 8/529

* cited by examiner

*Primary Examiner*—Margaret Einsmann
(74) *Attorney, Agent, or Firm*—Michael J. Striker

(57) ABSTRACT

In the process for continuously dyeing a poly(trimethylene terephthalate) bulked continuous filament yarn carpet an aqueous dyeing solution is applied to a continuously moving poly(trlmethylene terephthalate) bulked continuous filament yarn carpet at a temperature of 45° C. to 100° C., and then the poly(trimethylene terephthalate) bulked continuous filament yam carpet is steamed, rinsed and dried. Before applying the aqueous dyeing solution the carpet is heat-set at 120 to 150° C. The carpet is steamed with saturated steam at 102 to 150° C. for 5 to 10 mm. The aqueous dyeing solution does not include an anti-frosting agent. The process also advantageously includes heating the carpet with a dry heat of 140 to 300° C. for 30 to 60 sec after steaming the carpet and before rinsing it.

4 Claims, 1 Drawing Sheet

PROCESS FOR DYEING POLY (TRIMETHYLENE TEREPHTHALATE) CARPET CONTINUOUSLY

BACKGROUND OF THE INVENTION

1. Field of the Invention

The present invention relates, in general, to a process for dyeing poly(trimethylene terephthalate) (PTT) carpet continuously, and in particular, to a process for dyeing poly(trimethylene terephthalate) bulked continuous filament (BCF) yarn carpet continuously in a high color yield without poor dyeing.

2. Description of the Prior Art

As well known in the art, a PTT BCF yarn carpet can be continuously dyed by injecting an aqueous dyeing solution to pile of the PTT BCF yarn carpet through an applicator, steaming the carpet in a steamer to penetrate the aqueous dyeing solution into pile and fix it into pile of the carpet, followed by rinsing the steamed carpet, and drying the rinsed carpet.

However, according to the dyeing method as described above, a temperature distribution in the steamer is not uniform and a temperature in the steamer is lowered because a temperature of the carpet is different from a temperature in the steamer when the carpet, to which the aqueous dyeing solution is injected, passes through the steamer. Therefore, the aqueous dyeing solution cannot be sufficiently penetrated into fibers of the carpet, so that a color yield is reduced and the carpet cannot be uniformly dyed owing to frosting.

SUMMARY OF THE INVENTION

Therefore, it is an object of the present invention to provide a process for dyeing a poly(trimethylene terephthalate) carpet continuously, in which an aqueous dyeing solution is sufficiently penetrated into pile of a PTT BCF yarn carpet by minimizing a difference between a temperature of the carpet and a temperature in the steamer.

It is still another object of the present invention to provide a process for dyeing a poly(trimethylene terephthalate) carpet continuously to prevent frosting, which is a phenomenon wherein a drop of water is condensed at an end of a carpet pile owing to a temperature difference between the carpet and the steamer.

It is yet another object of the present invention to provide a process for dyeing a poly(trimethylene terephthalate) carpet continuously, in which the PTT BCF yarn carpet can be dyed in a high color yield and in a deep color.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

A detail of the present invention will be described in conjunction with FIGS. 1 and 2.

Figure 1:
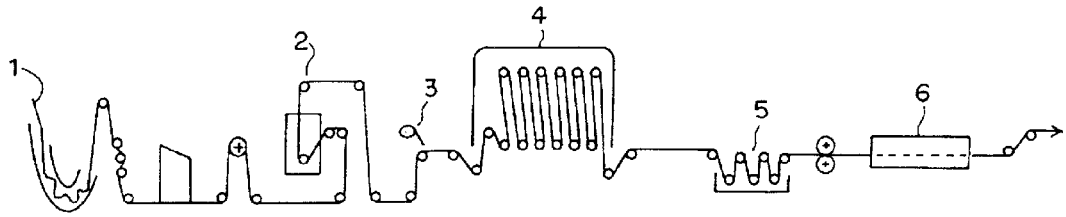
FIG. 1 schematically illustrates a dyeing process of a poly(trimethylene terephthalate) carpet according to an embodiment of the present invention.

With reference to FIG. 1, there is schematically illustrated a dyeing process of a poly(trimethylene terephthalate) carpet according to an embodiment of the present invention. As seen in the drawing of FIG. 1, a PTT BCF yarn carpet is heat-set in a heat setting room 2 at 120 to 150° C. to minimize a difference between a temperature of the carpet passing through a steamer 4 and a temperature of the steamer 4, and an aqueous dyeing solution at room temperature is provided to the carpet through an applicator 3 while the carpet is heat-set so that a pick up ratio is 100 to 500%, more preferably 250 to 350%. Thereafter, the carpet is steamed under atmospheric pressure in the steamer 4 at 102 to 150° C. with saturated steam for 5 to 10 min, rinsed in a rinsing bath 5, and dried in a dryer 6, thereby the PTT BCF yarn carpet can be continuously dyed with an increased color yield.

According to the present invention, a temperature of the heat setting room 2 is preferably within a range of 120 to 150° C., and most preferably 140° C. Also, heat setting time is 7 min.

Because the carpet heated to 120 to 150° C. is provided to the steamer 4, a temperature in the steamer 4 is not lowered and a temperature distribution in the steamer 4 becomes uniform, and so the carpet can be uniformly dyed with a high color yield.

A moving speed of the carpet 1 is preferably 5 to 10 m/min, and most preferably 7 to 8 m/min.

To obtain a high dyeing concentration at a temperature as low as possible within a range of 102 to 150° C., a temperature range in the steamer 4, a fixing accelerator or an anti-migration agent of a dye, or a carrier may be used in combination with a dyeing solution.

According to the present invention, a viscosity of the aqueous dyeing solution is preferably 30 to 300 cps. For example, when the viscosity is higher than 300 cps, the aqueous dyeing solution is hard to penetrate into pile. On the other hand, when the viscosity is lower than 30 cps, a dyeing is not uniformly accomplished because the aqueous dyeing solution oozes from pile or a frosting phenomenon occurs. The viscosity is most preferably 100 to 150 cps.

To dye the carpet deeply, a high concentration of a dye should be contained in pile by increasing the viscosity of the aqueous dyeing solution. However, if the viscosity is too high, it is difficult to remove a thickening agent in the future process.

The method of the present invention may be applied to a multi color dyeing, but requires a number of heat recovery devices corresponding to the number of colors. Furthermore, in case of the multi color dyeing, a spray type or a jet spray type applicator 3 can be used.

Referring to FIG. 1, an embodiment of a method for continuously dyeing a PTT BCF carpet according to the present invention is shown, in which the aqueous dyeing solution heated to 45 to 90° C. through a separating heating device (not shown in FIG. 1) is used instead of the aqueous dyeing solution at room temperature. When the heated aqueous dyeing solution is used, poor dyeing can be prevented and the carpet can be uniformly dyed without a anti-frosting agent because a temperature difference between the aqueous dyeing solution and an inside of the steamer 4 becomes small and so frosting, which is a phenomenon wherein steam at an upper side of carpet pile is condensed into drops of water, can be prevented without a anti-frosting agent.

Figure 2:
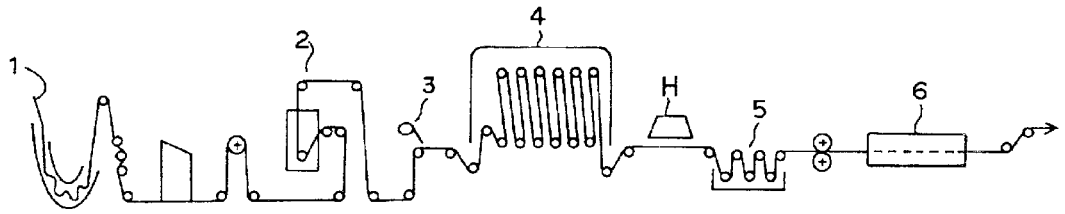
FIG. 2 schematically illustrates a dyeing process of a poly(trimethylene terephthalate) carpet according to another embodiment of the present invention.

Referring to FIG. 2, another embodiment of the method for continuously dyeing the PTT BCF carpet according to the present invention is shown, in which the aqueous dyeing solution containing an anti-migration agent at room temperature is provided through an applicator 3 to the PTT BCF carpet heat-set at 120 to 150° C. and continuously moving, thereafter the carpet is steamed with saturated steam under atmospheric pressure in the steamer 4 at 102 to 150° C. for 5 to 10 min, heated with a dry heat at 140 to 300° C. through a heating zone H for 30 to 60 sec before rinsing the carpet so that a dye is sufficiently penetrated into the carpet, rinsed, and dried.

According to the present invention, a fixing accelerator may be added to the aqueous dyeing solution provided through the applicator 3 to prevent a color yield from being reduced owing to a temperature restriction of the steamer 4 under atmospheric pressure.

Also, the anti-migration agent may be added to the dyeing solution to prevent the dye from migrating through the heating zone H, in which the carpet is heated with a dry heat at high temperature, so that a color yield is increased. If heating temperature and time in the heating zone H are deviated from the above range, it is difficult to dye deeply the PTT BCF yarn carpet having a good fastness.

Furthermore, an infrared irradiator or an electric heater may be used as a thermal medium of the heating zone H, and a quantity of heat irradiated to the carpet may be controlled by controlling a distance between the thermal medium and the carpet or controlling a capacity of the thermal medium may control a quantity of heat irradiated to the carpet. In addition, an anti-form agent, a softener, and a flame retardant may also be added to the dyeing solution to increase the functionality of the carpet.

EXAMPLES AND COMPARATIVE EXAMPLES

A better understanding of the present invention may be obtained in light of the following examples which are set forth to illustrate, but are not to be construed to limit the present invention.

Examples 1 to 3

A high-energy type disperse dye was used. A degree of penetration of the dye into fibers when a temperature of a steamer is 140° C. was observed and determined according to steaming time. The results are described in Table 1.

TABLE 1

| Steaming time (min) | 5 | 7 | 10 |
|---|---|---|---|
| Degree of penetration of the dye into fibers | Δ | ○ | ○ |

*○: good, Δ: average, X: poor

The degree of penetration of dyes into fibers was determined by observing a cross section of dyed BCF yarns through a microscope. As seen in Table 1, when the carpet was steamed at 140° C. for 7 or 10 min, a dye was penetrated to an inside of fibers, so that a dyeing was sufficiently accomplished. On the other hand, when the carpet was steamed for less than 5 min, a ring-dyeing phenomenon was observed.

Examples 4 to 6

A high-energy type disperse dye was used. When the carpet was steamed for 7 min according to a temperature of the steamer, a color yield of the carpet was represented by the K/S value of dyed goods steamed at a certain temperature as the percentage of the K/S value of dyed goods steamed at 140° C. The results are described in Table 2, below.

TABLE 2

| Temperature of steamer (° C.) | Relative color yield (%) |
|---|---|
| 140 | 100 |
| 120 | 60–80 |
| 102 | 50–60 |

In case of using a high-energy type dye, when the temperature of the steamer was lowered, the color yield was remarkably reduced. When the carpet was steamed at 102° C., the color yield was reduced by 50% at maximum according to a kind of the dye, in comparison with the color yield of the carpet steamed at 140° C.

Examples 7 to 8 and Comparative Example 1

A low-or medium-energy type disperse dye was used. When the carpet was steamed for 7 min according to a temperature of the steamer, a color yield of the carpet was represented by the K/S value of dyed goods steamed at a certain temperature as the percentage of the K/S value of dyed goods steamed at 140° C. The results are described in table 3.

TABLE 3

| | Temperature of steamer (° C.) | Relative color yield (%) |
|---|---|---|
| EX. 7 | 140 | 100 |
| EX. 8 | 120 | 90–95 |
| Co. EX. 1 | 100 | 70–80 |

In case of using a low- or medium-energy type dye, when the carpet was steamed at 120° C., a decrement of the color yield was largely reduced, in comparison with the one steamed at 140° C.

However, when the carpet was steamed at 100° C., the color yield was as low as before and ring-dyeing occurred, which is a phenomenon wherein the dye is not sufficiently penetrated to an inside of fibers. Therefore, preferable dyeing conditions for the dye to be sufficiently penetrated into the inside of fibers are that the carpet is steamed in the steamer at 102 to 150° C. for 5 to 10 min.

When the temperature of the steamer was 100° C. or so and a pressure in the steamer is atmospheric pressure, the carpet could be dyed in a restricted color range from light to medium shade.

Example 9 and Comparative Examples 2 and 3

A low- or medium-energy type disperse dye was used. In example 9, the anti-frosting agent was not used and a temperature of the dyeing solution provided through an applicator was controlled within a range of 45 to 100° C.

In comparative example 2, the anti-frosting agent was not used and the temperature of the dyeing solution provided through the applicator was controlled to room temperature. On the other hand, in comparative example 3, the anti-frosting agent was used and the temperature of the dyeing solution provided through the applicator was controlled to the normal room temperature.

After the carpet was steamed in the steamer at 120° C. for 7 min, an inhibition effect versus frosting was evaluated. When the dyeing solution was provided at 45 to 100° C., the goods dyed without using the anti-frosting agent had a similar appearance to the goods dyed with using the anti-frosting agent. The results are described in table 4.

TABLE 4

| | Inhibition effect of frosting |
|---|---|
| Example 9 | ○ |
| Comparative example 2 | X |
| Comparative example 3 | ◎ |

*◎: excellent, ○: good, Δ: average, X: poor

Examples 10 to 11 and Comparative Examples 4 to 5

As a disperse dye, 2 g/l of a low-energy type Dianix Ace dye (manufactured by Dystar Co.) was used. The carpet was dyed with an aqueous dyeing solution having a viscosity of 100 cps so that a pick up ratio is 400 wt %. 1 g/l of anti-migration agent C82 (manufactured by Yorkshire Co.) was used.

The carpet dyed with the above aqueous dyeing solution was steamed under atmospheric pressure in the steamer for 6 min, heated with a dry heat at 200° C. before rinsing the carpet and subjected to a fixation of a dye at various heating times, followed by being rinsed and dried.

A K/S value was measured by a colorimeter.

A deepness of color was determined by comparing the K/S value of the carpet heated for a certain heating time with the K/S value of the carpet heated for 30 sec as a standard. Furthermore, a color fastness to wetting was evaluated according to a KS K0430 method. The results are described in table 5.

TABLE 5

| | Co. Ex. 4 | Ex. 10 | Ex. 11 | Co. Ex. 5 |
|---|---|---|---|---|
| Heating time (sec) | 0 | 30 | 60 | 120 |
| Relative color yield (%) | 94–96 | 100 | 102–104 | 96–98 |
| Color fastness to wetting (grade) | 4 | 4–5 | 4–5 | 4–5 |

As seen in Table 5, the carpet heated for 60 sec was increased by 2 to 4% in relative color yield in comparison with the carpet heated by dry heat for 30 sec. If the carpet was heated for over 1 min, the relative color yield was reduced because the quantity of fixed dye was reduced owing to a sublimation of a low-energy type dye at a high temperature.

Comparative Example 6

The carpet was dyed under atmospheric pressure in the steamer for 6 min without an anti-migration agent according to examples 10 and 11, and heated with dry heat at 180° C. for 30 sec before rinsing the dyed carpet. Relative color yields according to heating time were evaluated and compared with those of example 10. The results are described in table 6.

Comparative Example 7

The carpet was dyed under atmospheric pressure in the steamer for 6 min without the anti-migration agent according to examples 10 and 11. The dyed carpet was not heated by dry heat. Relative color yields according to heating times were evaluated and compared with those of example 10. The results are described in table 6.

TABLE 6

| | Ex. 10 | Co. Ex. 6 | Co. Ex. 7 |
|---|---|---|---|
| Heating time (sec) | 30 | 30 | 0 |
| Anti-migration agent | Used | Not used | Not used |
| Relative color yield (%) | 100 | 88–93 | 75–84 |

As seen in table 6, the carpet of comparative example 6 without using the anti-migration agent was reduced in color yield in comparison with the carpet heated by dry heat for 30 sec with the use of the anti-migration agent according to example 10 because the carpet was not sufficiently dyed owing to a migration of the dye in the steamer and during the high temperature heating by a dry heat. Also, it can be seen from comparative example 7 that the high temperature heating by the dry heat in a heating zone H before rinsing the carpet endows the carpet with improved color yield.

As described above, according to this invention, the PTT BCF yarn carpet of the present invention can be dyed to uniform color with a high color yield and in a deep color.

In other words, the PTT BCF yarn carpet can be continuously subjected to even dyeing without occurrence of poor dyeing such as frosting, even though a anti-frosting agent is not used.

Furthermore, the PTT BCF yarn carpet of the present invention can be continuously dyed in a deep color without occurrence of ring-dyeing.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A process for continuously dyeing poly(trimethylene) terephthalate bulk continuous filament yarn carpet, said process comprising the steps of:

a) heat-setting a poly(trimethylene) terephthalate bulk continuous filament yam carpet at 120° C. to 150° C.;

b) moving a poly(trimethylene) terephthalate bulk continuous filament yarn carpet to provide a continuously moving carpet moving at a speed of from 5 to 10 m/mm;

c) after said heat-setting, applying an aqueous dyeing solution having a viscosity of from 30 to 300 cps and a temperature of 45° C. to 100° C. to said continuously moving carpet, said aqueous dyeing solution not including an anti-frosting agent;

d) after said applying of step c), steaming said poly (trimethylene) terephthalate bulk continuous filament yam carpet with saturated steam at 102° C. to 150° C. for 5 to 10 mm; and e) after said steaming, rinsing and then drying said poly(trimethylene) terephthalate bulk continuous filament yam carpet;

whereby said poly(trimethylene) terephthalate bulk continuous filament yarn carpet is dyed to a uniform and fast color.

2. The process as defined in claim 1, wherein said aqueous dyeing solution comprises an anti-migration agent.

3. The process as defined in claim 1, further comprising drying said poly(trimethylene) terephthalate bulk continuous filament yam carpet with a dry heat at 140° C. to 300° C. after said steaming and before said rinsing.

4. The process as defined in claim 1, wherein said viscosity of said aqueous dyeing solution is from 100 to 150 ops.

* * * * *